US006927374B2

(12) United States Patent
Hu et al.

(10) Patent No.: US 6,927,374 B2
(45) Date of Patent: Aug. 9, 2005

(54) DOOR ASSEMBLY OF MICROWAVE OVEN

(75) Inventors: Jin-Yul Hu, Seoul (KR); Eung-Su Kim, Seoul (KR); Yang-Kyeong Kim, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/784,291

(22) Filed: Feb. 24, 2004

(65) Prior Publication Data

US 2005/0056639 A1 Mar. 17, 2005

(30) Foreign Application Priority Data

Sep. 15, 2003 (KR) ..... 10-2003-0063588

(51) Int. Cl.[7] ..... H05B 6/76
(52) U.S. Cl. ..... 219/742; 219/741; 174/35 GC
(58) Field of Search ..... 219/741–744; 174/35 R, 35 GC

(56) References Cited

U.S. PATENT DOCUMENTS 4,313,044 A * 1/1982 Staats ..... 219/742
5,206,478 A * 4/1993 Lee ..... 219/742

FOREIGN PATENT DOCUMENTS

JP 53-37931 * 4/1978 ..... 219/742

* cited by examiner

*Primary Examiner*—Philip H. Leung
(74) *Attorney, Agent, or Firm*—Greenblum & Bernstein, P.L.C.

(57) ABSTRACT

A door assembly for a microwave or electric oven in which an optimum microwave-shielding frequency is not changed even though an incident angle of microwaves is changed, to enhance a user's convenience in cleaning a door. The door assembly for a microwave oven includes a door frame to open and close a cooking cavity, a door filter having a filter plate adhered to one side of the door frame, a choke portion bent to an opposite side of the cooking cavity in an edge of the filter plate, a first slot formed in a width direction of the choke portion, and a second slot formed in a length direction of the choke portion.

18 Claims, 10 Drawing Sheets

DOOR ASSEMBLY OF MICROWAVE OVEN

This application claims the benefit of the Korean Application No. P2003-63588, filed on Sep. 15, 2003, which is hereby incorporated by reference.

BACKGROUND OF THE INVENTION

1. Field of the Invention

The present invention relates to a microwave oven, and more particularly, to a door assembly of a microwave oven, to prevent microwave irradiated to a cooking cavity from leaking externally.

2. Discussion of the Related Art

In general, a microwave oven melts or cooks food with frictional heat generated when vibrating molecules of food by irradiating microwave. Recently, an electric oven has been used, in which a heater is provided to cook various kinds of food. Hereinafter, the structure of general microwave and electric ovens will be described with reference to the accompanying drawings.

Referring to FIG. 1, an outer case 10 having the open front is provided in the microwave or electric oven, and a front frame 11 is provided in the circumference of the open front of the outer case 10. Then, an inner case 20 is provided in the inside of the outer case 10. At this time, an opening is provided in front of the inner case 20, and an inside space of the inner case 20 forms a cooking cavity for cooking food. Meanwhile, a door 30 is hinged on the front frame 11 so as to open and close the opening of the inner case 20.

Also, a heater 44 and a ventilating fan 46 may be provided at an upper part, a lower part, or a side part to the inner case 20. The heater 44 heats the cooking cavity 25, and the ventilating fan 46 generates a circulating air current inside the cooking cavity 25. Accordingly, food received in the cooking cavity 25 is heated with heat irradiated from the heater 44, and the hot air circulating inside the cooking cavity 25 by the ventilating fan 46.

Then, an outfit chamber 40 is provided between the outer case 10 and the inner case 20. At this time, the outfit chamber 40 is provided with a magnetron 41 for generating the microwave, a high-voltage transformer 42 for providing a high voltage to the magnetron, a wave guide 43 for guiding the microwave generated by the magnetron 41 to the cooking cavity 25, and a cooling fan 44 for cooling electric components provided in the inside of the outfit chamber 40. As shown in FIG. 1, the outfit chamber 40 may be provided at an upper part of the cooking cavity 25. Or, as shown in FIG. 2, the outfit chamber 40 may be provided at a side part of the cooking cavity 25.

In the microwave or electric oven having the aforementioned structure, when the door 30 is closed in state of having food inside the cooking cavity 25, the microwave or electric oven is put into operation. That is, the microwave generated by the magnetron 41 is irradiated to the inside of the cooking cavity 25. At this time, some of the microwave arrives on food directly (progressive wave), and the rest arrives on food after being firstly reflected by the inner surface of the inner case 20 (reflective wave). Thus, the microwave or electric oven heats food uniformly by using the microwave of multi-wavelength in which the progressive and reflective waves are compounded. In this case, the heater 44 and the ventilating fan 46 are used at need.

If the microwave irradiated to the cooking cavity 25 leaks externally, and directly irradiates the human body, it is very dangerous to the human body. Thus, it is required to provide the door 30 with a microwave-leakage prevention structure. The structure of the door will hereinafter be described with reference to FIG. 3 and FIG. 4.

Referring to FIG. 3 and FIG. 4, the door 30 is provided with a door panel 31 forming the exterior, and a door filter 35 attached to the inner surface of the door 30 so as to prevent the microwave leakage. At this time, as shown in FIG. 3, an edge 31*a* of the door panel 31 is in contact with the front frame 11 when the door 30 is closed, whereby the cooking cavity 25 is closed completely and tightly. Also, as shown in FIG. 4, a choke portion 35*a* is provided in an edge of the door filter 35, the choke portion 35*a* curved to the outer surface of the door 30. In this state, the choke portion 35*a* is provided with a plurality of linear slots 35*b*, and the plurality of linear slots 35*b* are provided at fixed intervals in a length direction of the choke portion 35*a*. In this structure, the choke portion 35*a* of the door filter 35 prevents the microwave from leaking through a gap of the door 30 to the external, thereby improving heat efficiency and safety of the cooking cavity 25.

However, the door filter 35 having the aforementioned structure according to the related art has the following disadvantages.

In the choke portion 35*a*, an optimum microwave-shielding frequency is changed according to an incident angle of microwave on the door 30, whereby it causes the deterioration of microwave-shielding efficiency. Hereinafter, this will be described in detail.

Referring to FIG. 5, in the door filter 35 including the choke portion 35*a* having the linear slot 35*b*, when the incident angle of microwave is at 15.6°, 21.9°, and 35.6°, a resonant point is formed at about 125 dB, 120 dB, and 90 dB, and a corresponding frequency for forming the resonant point in each incident angle is 2.5 GHz, 2.55 GHz, and 2.59 GHz. At this time, the frequency, at which the resonant point is formed, is referred to as the optimum microwave-shielding frequency. Thus, it is possible to obtain the maximum microwave-shielding efficiency at the optimum microwave-shielding frequency.

In the aforementioned door filter 35 according to the related art, the optimum microwave-shielding frequency is changed according to the incident angle of the microwave, so that the microwave may leak to the external whenever the incident angle of the microwave on the door 30 is changed. Accordingly, the microwave-shielding efficiency of the door filter 35 is deteriorated, thereby lowering manufactures' safety.

Also, in case the slot 35*b* extends to one portion of the door filter 35 being in contact with the cooking cavity 25 as well as to the choke portion 35*a*, it is possible to decrease the change of the optimum microwave-shielding frequency according to the incident angle of the microwave. In this case, moisture generated from food inside the cooking cavity 25 may come into the slot 35*b*, whereby it causes a user's inconvenience of cleaning the door 300.

SUMMARY OF THE INVENTION

Accordingly, the present invention is directed to a door assembly for a microwave or electric oven that substantially obviates one or more problems due to limitations and disadvantages of the related art.

An object of the present invention is to provide a door assembly for a microwave or electric oven, having an improved structure in which an optimum microwave-shielding frequency is not changed even though an incident angle of microwave is changed, to obtain a user's convenience for cleaning a door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a door assembly for a microwave oven includes a door frame to open and close a cooking cavity; and a door filter having a filter plate adhered to one side of the door frame, a choke portion bent to an opposite side of the cooking cavity in an edge of the filter plate, a first slot formed in a width direction of the choke portion, and a second slot formed in a length direction of the choke portion.

At this time, the choke portion is provided at a predetermined interval from the door frame.

Also, the plurality of first and second slots are provided at fixed intervals along the length direction of the choke portion.

Also, the choke portion is bent in vertical to the filter plate.

Also, the first slot is provided along a direction being vertical to an end portion in the edge of the filter plate, and the second slot is provided along a direction being parallel to the end portion in the edge of the filter plate.

The first slot is formed from a point provided at a predetermined interval from the edge of the filter plate to an end portion of the choke portion.

Also, a length of the first slot is formed in a degree corresponding to ¼ of the wavelength ($\lambda$) of the microwave irradiated to the cooking cavity.

The second slot is provided between the first slot and the end portion in the edge of the filter plate. In this case, one end of the first slot is connected with a central portion of the second slot, or one end of the first slot is connected with one end of the second slot.

In another aspect, one end of the second slot is connected with a central portion of the first slot.

In another aspect, the first and second slots cross each other.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
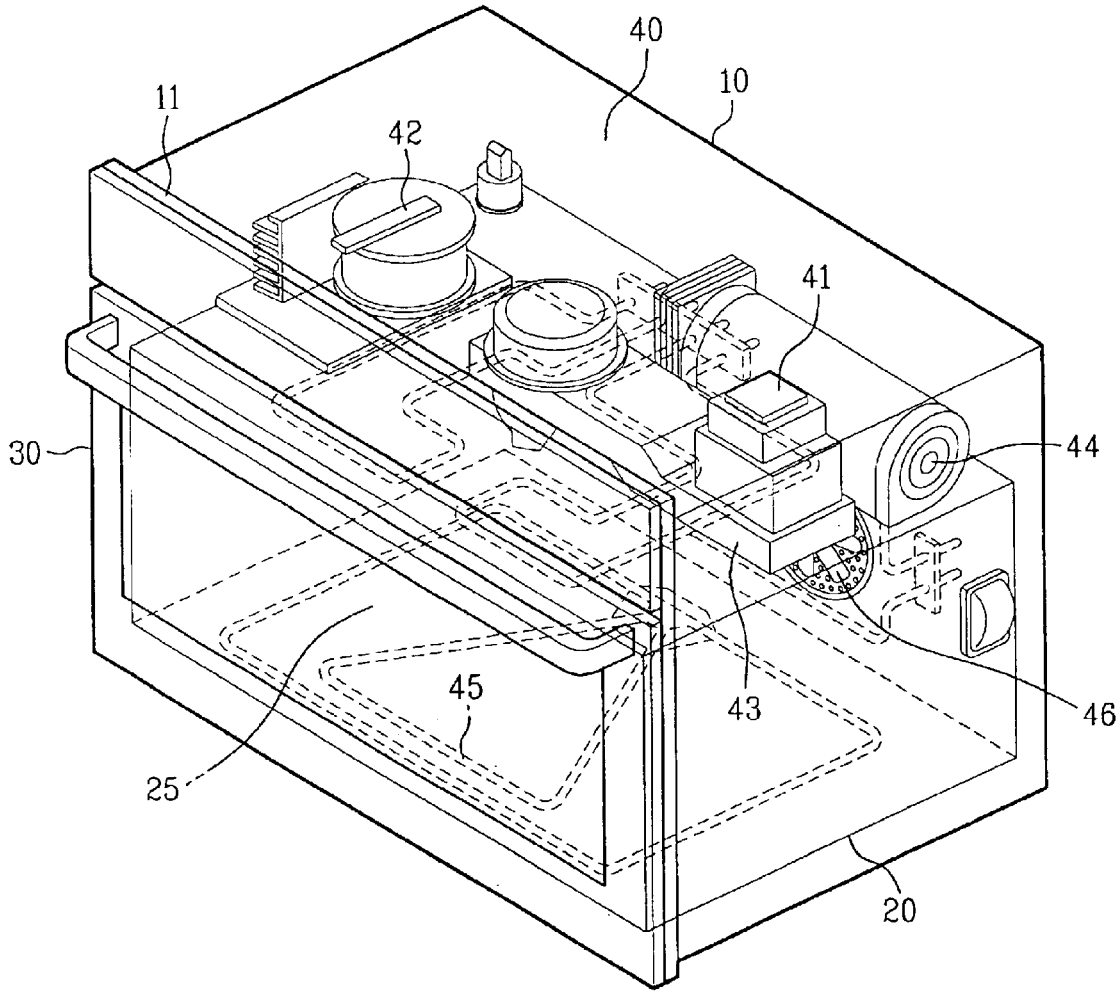
FIG. 1 Prior Art
FIG. 1 is a perspective view schematically illustrating a general electric oven.
Figure 2:
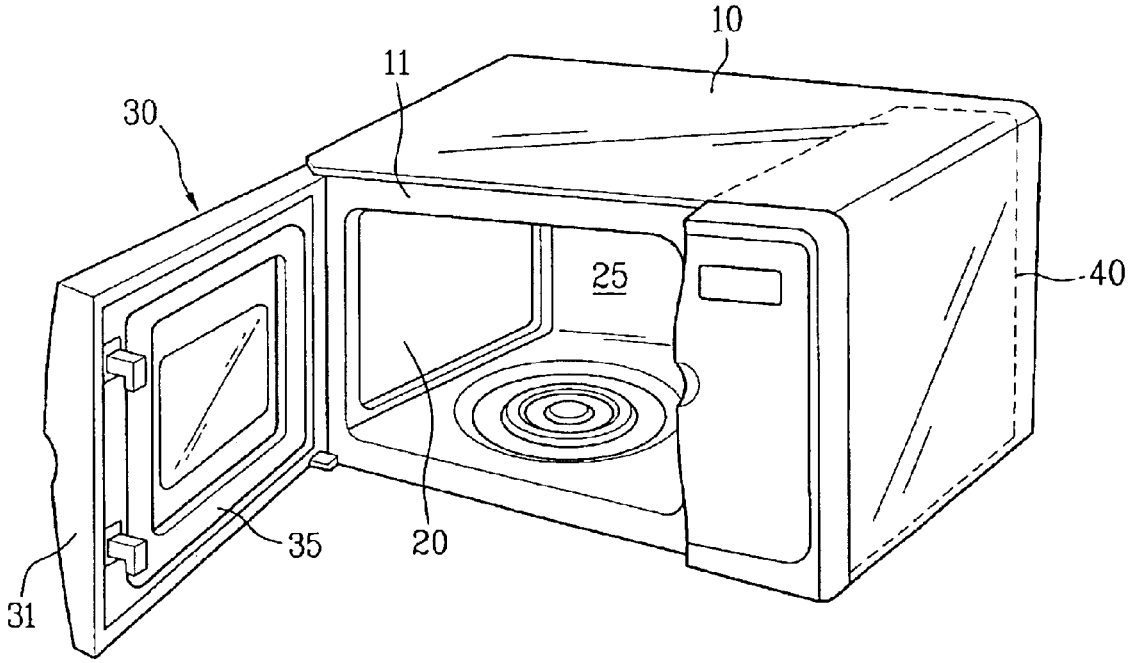
FIG. 2 Prior Art
FIG. 2 is a perspective view schematically illustrating a general microwave oven.

A door assembly according to the present invention may be applied for all kinds of microwave and electric ovens for heating food in a cooking cavity by using microwave. At this time, these structures will be similar to that explained in FIG. 1 and FIG. 2. Accordingly, the explanation for the entire structure of the microwave and electric ovens will be omitted, hereinafter, the door assembly according to the present invention will be described in detail.

Figure 3:
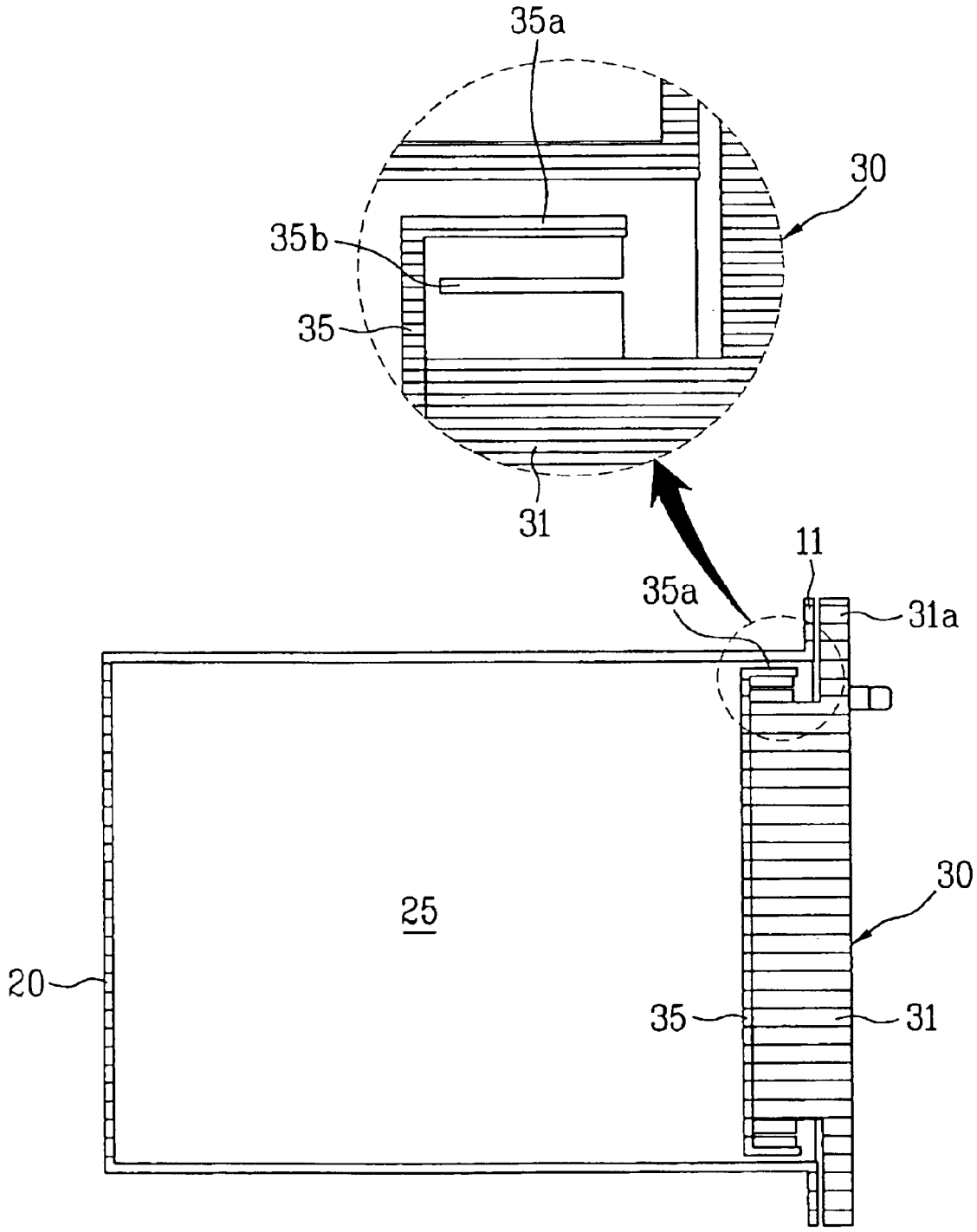
FIG. 3 Prior Art
FIG. 3 is a cross-sectional view schematically illustrating an inner case and a door assembly of FIG. 1.
Figure 4:
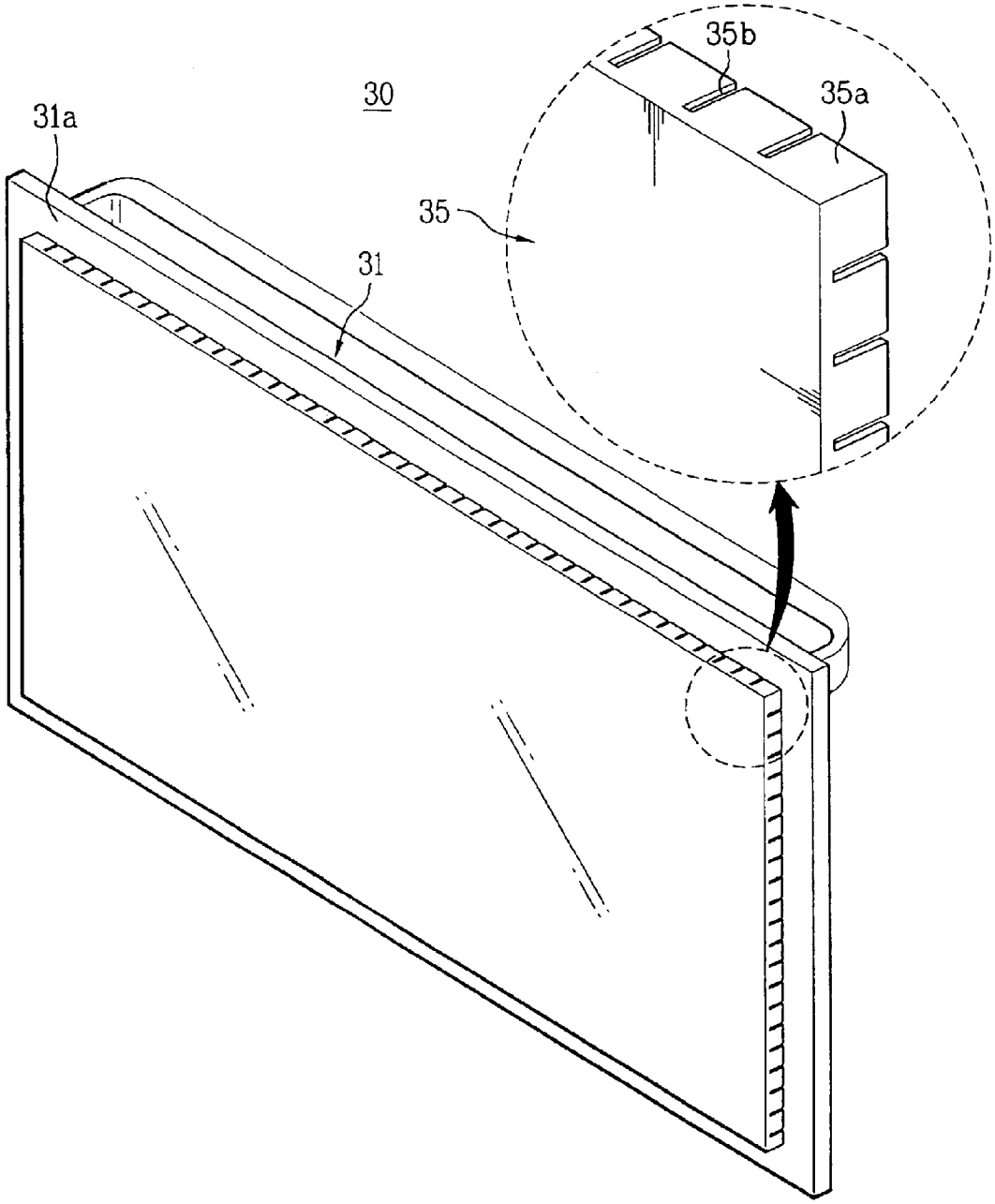
FIG. 4 Prior Art
FIG. 4 is a perspective view illustrating a door assembly of FIG. 3.
Figure 5:
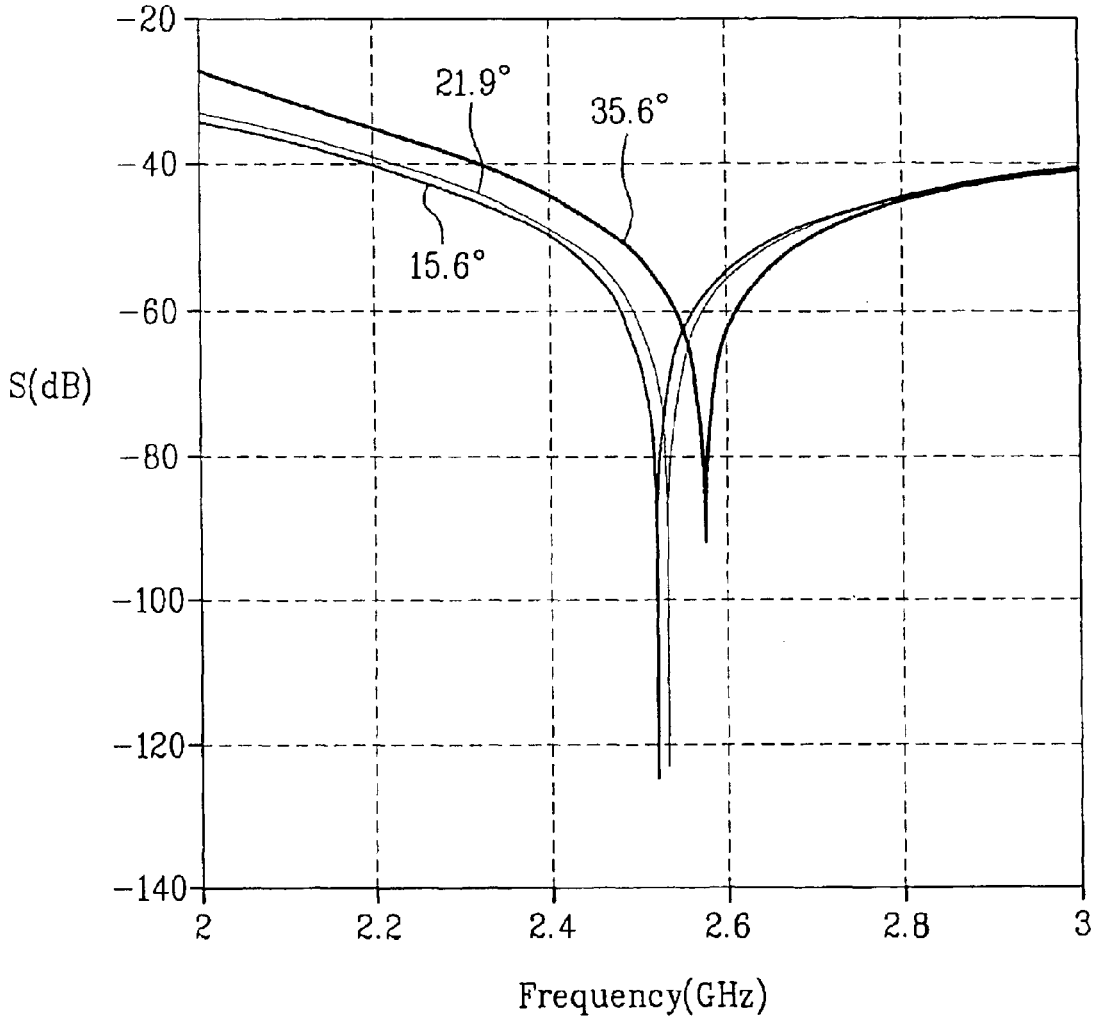
FIG. 5 Prior Art
FIG. 5 is a graph illustrating microwave-shielding characteristics of a door assembly shown in FIG. 4.

As shown in FIG. 6 to FIG. 9, the door assembly according to the present invention is provided so as to open and close a cooking cavity (not shown) provided in the inside of the microwave or electric oven. In this case, the door assembly is provided with a door frame 100 and a door filter 200. At this time, the door frame 100 is hinged on one side of the microwave or electric oven. Thus, when the door assembly is closed, the edge of the door frame 100 is in contact with a front frame (FIG. 1 to FIG. 3) of the microwave or electric oven, whereby the cooking cavity is closed tightly. Also, the door filter 200 is adhered to the door frame 100 so as to prevent the microwave irradiated to the cooking cavity from leaking to the external.

Hereinafter, the door filter 200 will be described in detail. Referring to FIG. 6 to FIG. 9, the door filter 200 is provided with a filter plate 210 and a choke portion 220. In this state, the filter plate 210 is adhered to one surface of the door frame 100, and more particularly, to an opposing surface of the cooking cavity. The filter plate 210 prevents the microwave, incident on the door frame 100 after being irradiated to the inside of the cooling cavity, from leaking to the external.

Meanwhile, it is possible to provide the electric or microwave oven having a structure that a user can watch the inside of the cooking cavity. In this case, although not shown, the door frame 100 has an opening in the center thereof, and the filter plate 210 has a perforated portion having a plurality of apertures at a corresponding portion for covering the opening of the door frame 100. At this time, the opening of the door frame 100 is formed of glass. In this structure, it is possible to prevent leakage of microwave by forming the perforated portion, whereby the user can safely watch the inside of the cooking cavity through the opening.

The choke portion 220 is bent to an opposite side of the cooking cavity in the edge of the filter plate 210. Preferably, as shown in FIG. 6 to FIG. 9, the choke portion 220 is bent for being in vertical to the filter plate 210. At this time, it is preferable to maintain a predetermined interval between the choke portion 220 and the door frame 110 without being in contact with each other. Also, the choke portion 220 is provided with a plurality of slots 225, each slot 225 including a first slot 221 and a second slot 222. In this case, the plurality of slots 225 are provided at fixed intervals along a length direction of the choke portion 220.

Hereinafter, the slot 225 of the choke portion 220 will be described in detail.

As shown in FIG. 6 to FIG. 9, the first slot 221 is provided at a width direction of the choke portion 220 for being vertical to the end portion in the edge of the filter plate 210. The second slot 222 is provided at a length direction of the choke portion 220 for being parallel to the end portion in the edge of the filter plate 210. As shown in the drawings, the first slot 221 is formed from a starting point, being apart from the end portion in the edge of the filter plate 210, to the end portion of the choke portion 220.

At this time, it is preferable to form the length of the first slot 221 in a degree corresponding to ¼ of wavelength (λ) of microwave irradiated to the inside of the cooking cavity. However, the interval of the slot 225 is not limited to this, and the interval of the slot 225 may be slightly changed according to characteristics of optimum microwave-shielding frequency. Meanwhile, the first and second slots 221 and 222 are provided for being vertical to each other. In the door assembly according to the present invention, the form of forming the first and second slots 221 and 222 in vertical may be variable according to the preferred embodiments of the present invention.

Hereinafter, the door assembly according to the preferred embodiments of the present invention will be described briefly with reference to the accompanying drawings.

Figure 6:
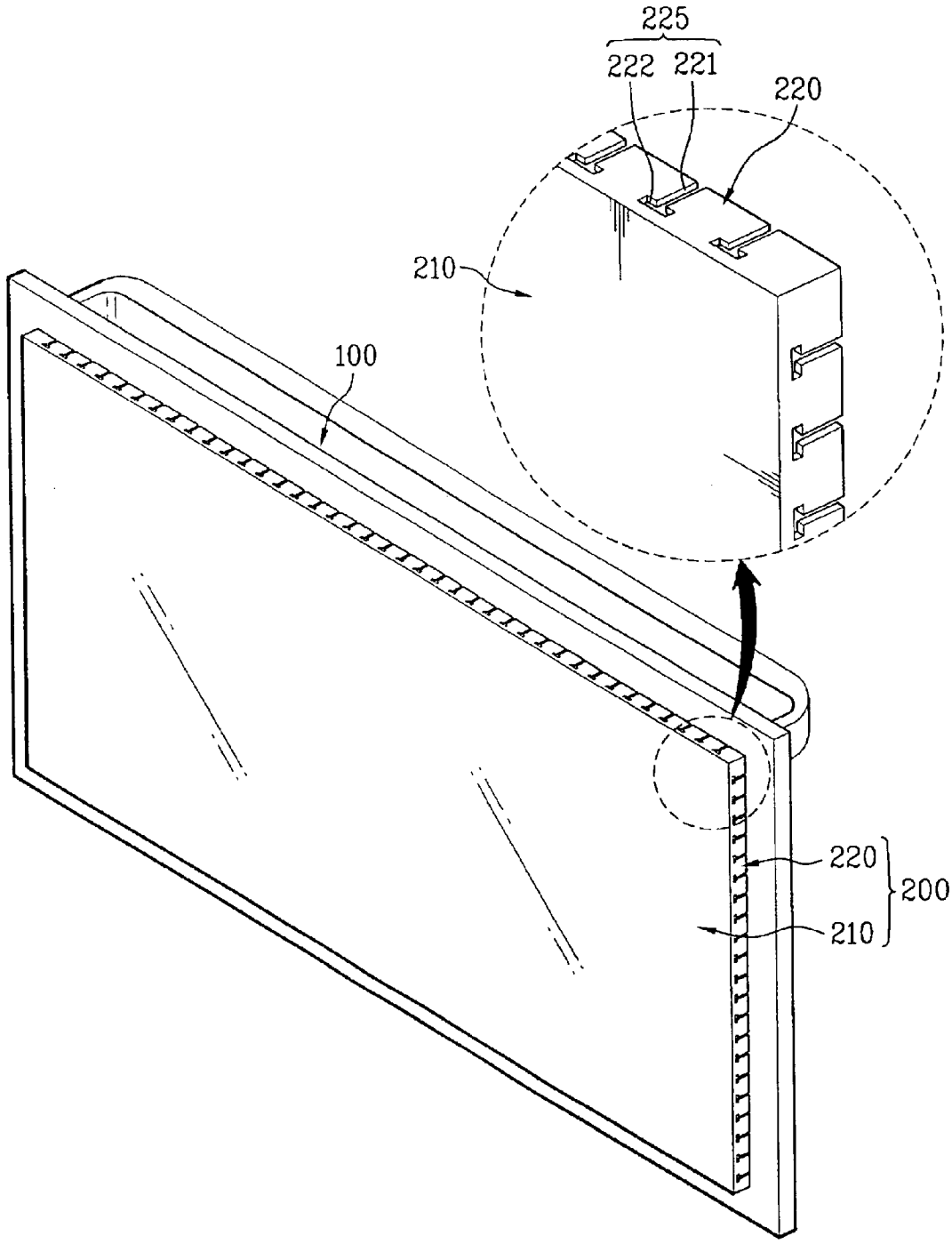
FIG. 6 is a perspective view illustrating a door assembly according to the first embodiment of the present invention.
Figure 7:
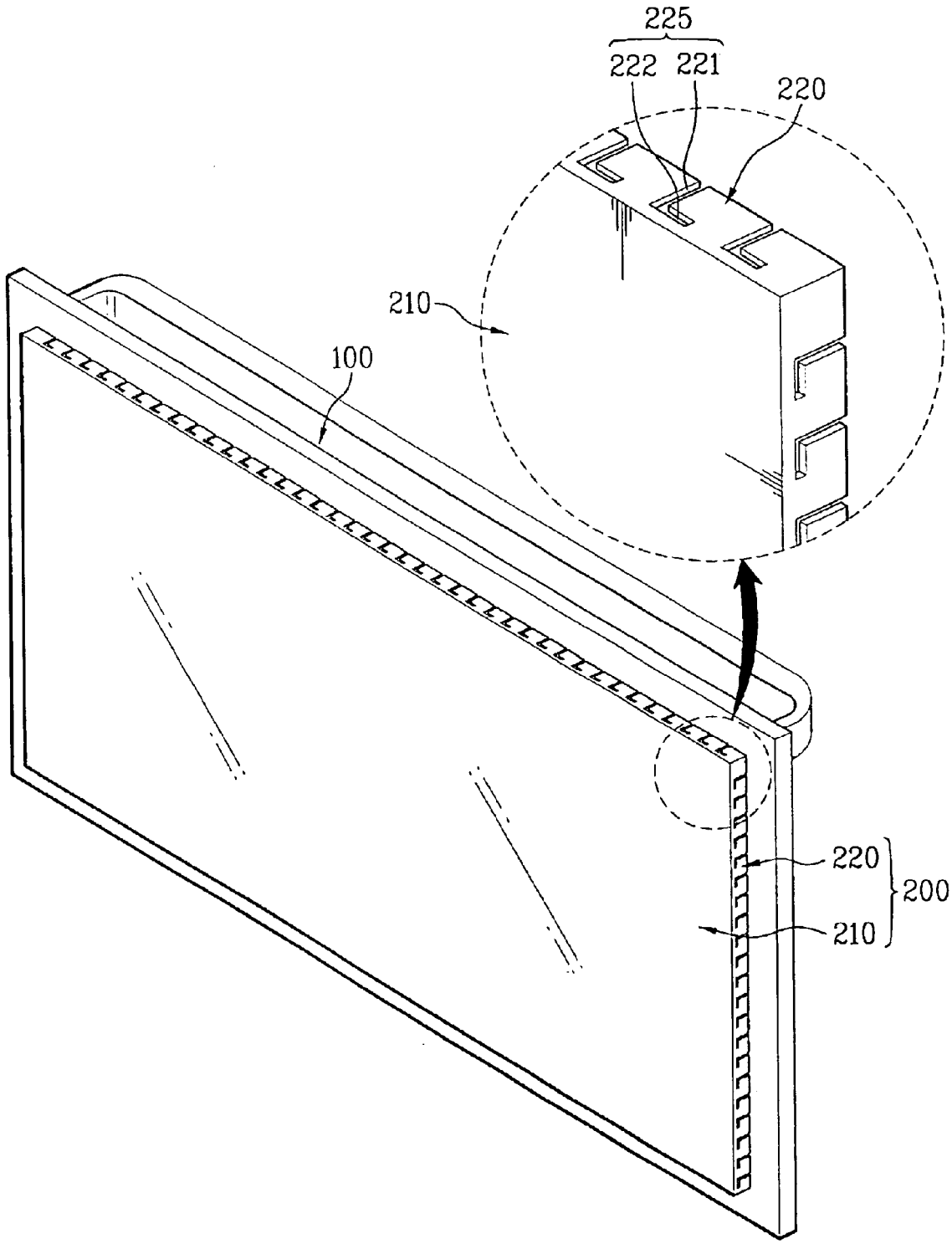
FIG. 7 is a perspective view illustrating a door assembly according to the second embodiment of the present invention.
Figure 8:
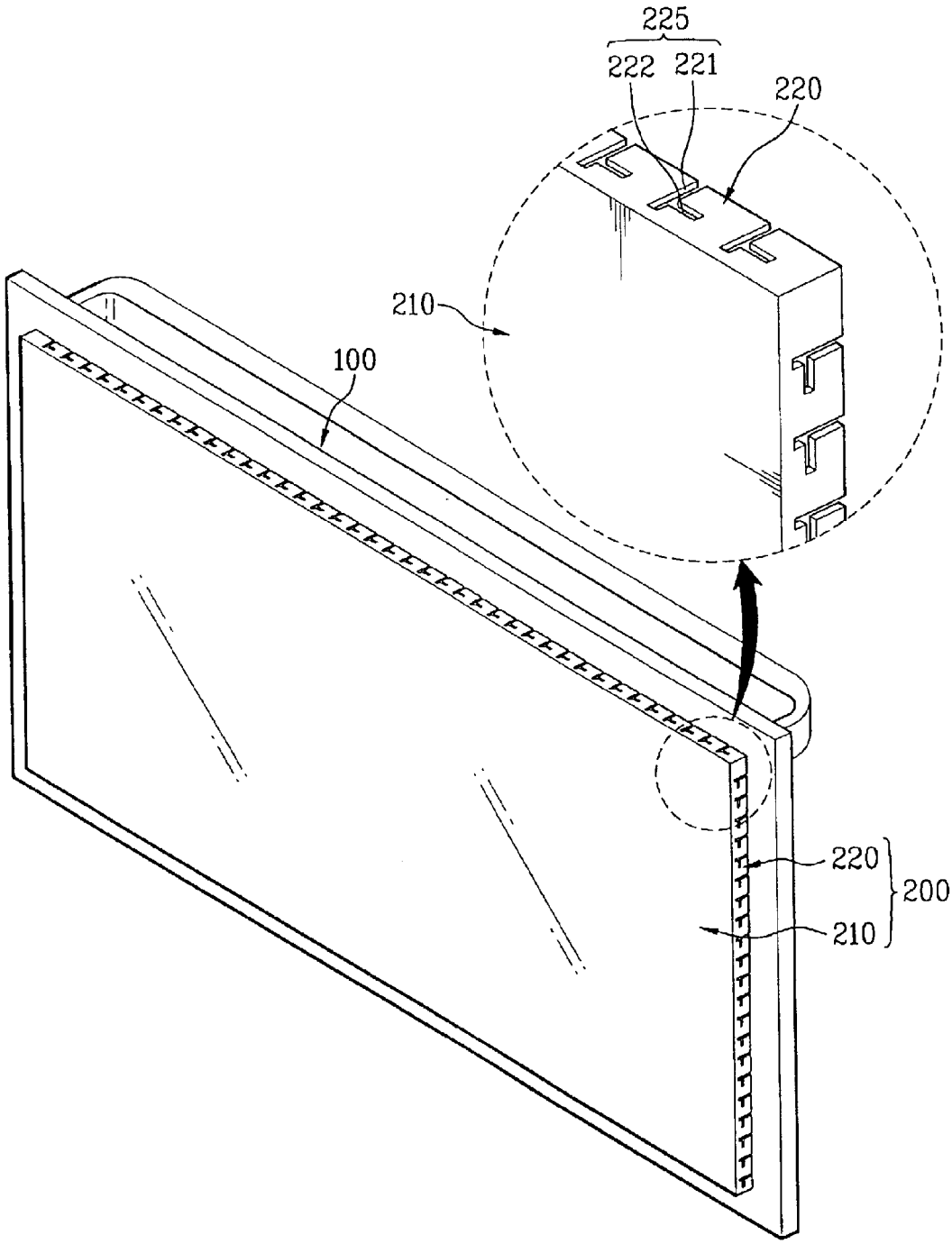
FIG. 8 is a perspective view illustrating a door assembly according to the third embodiment of the present invention.
Figure 9:
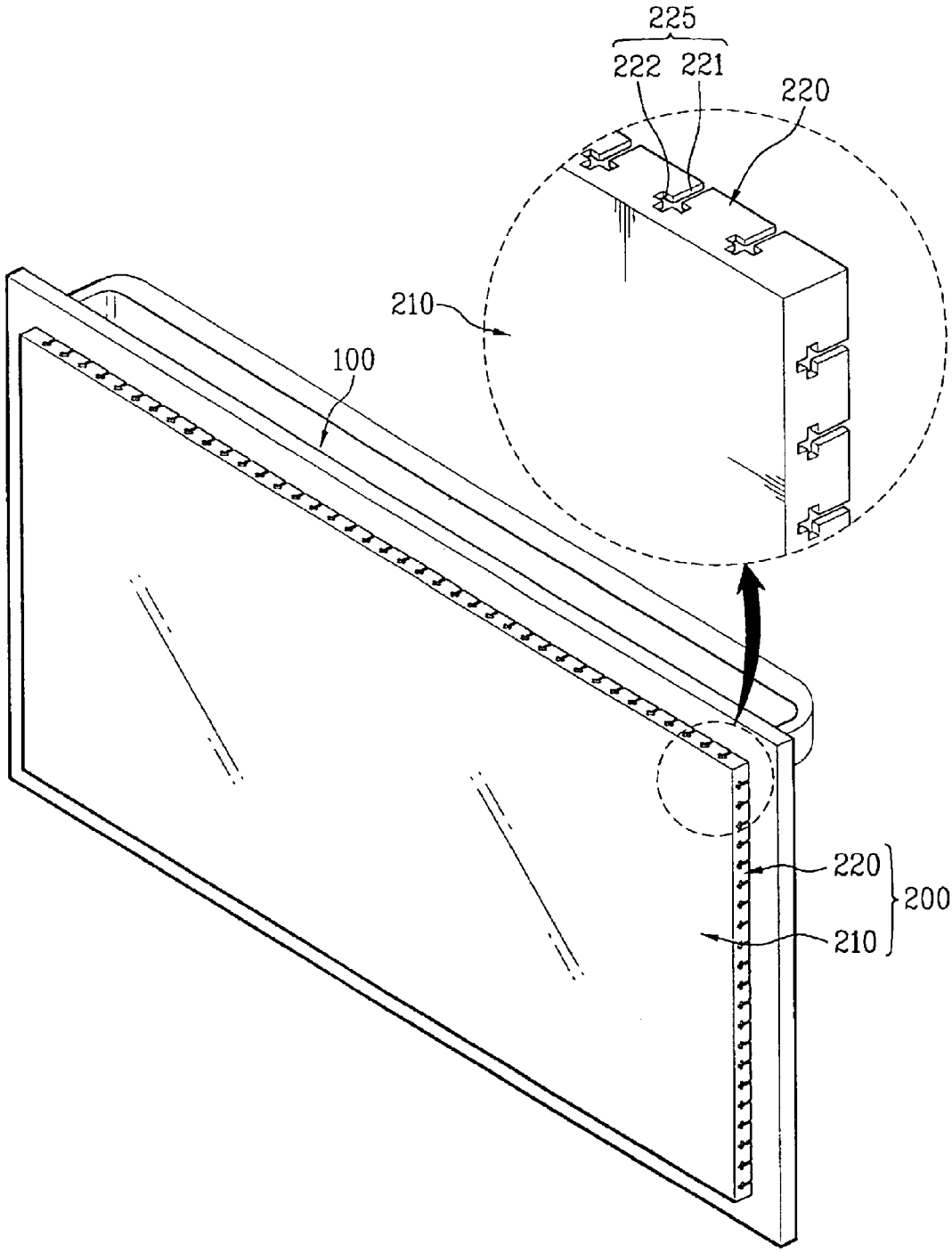
FIG. 9 is a perspective view illustrating a door assembly according to the fourth embodiment of the present invention.

First, as shown in FIG. 6 and FIG. 7, the second slot 222 may be formed between the first slot 221 and the end portion in the edge of the filter plate 210. In FIG. 6 illustrating the first embodiment of the present invention, one end of the first slot 221 is connected with a central portion of the second slot 222, that is, the slot 225 is formed in a shape of "T". Meanwhile, in FIG. 7 illustrating the second embodiment of the present invention, one end of the first slot 221 is connected with one end of the second slot 222, that is, the slot 225 is formed in a shape of "L". Next, FIG. 8 illustrates the third embodiment of the present invention, in which one end of the second slot 222 is connected with a central portion of the first slot 221. FIG. 9 illustrates the fourth embodiment of the present invention, in which the first slot 221 crosses the second slot 222, that is, the slot 225 is formed in a shape of "+".

In a door assembly according to the related art, a slot is formed in a linear shape. Meanwhile, the door assembly according to the preferred embodiment of the present invention is different from the door assembly according to the related art in that the first and second slots of the door assembly according to the present invention are formed in a perpendicular shape.

An operation of the door assembly having the structure according to the present invention will be described in brief.

First, the microwave irradiated to the cooking cavity is directly incident on food received in the cooking cavity, or is incident on food after being reflected on the side surface of the cooking cavity. Accordingly, food received in the cooking cavity is heated uniformly with the microwave irradiated at different angles. At this time, some of the microwave, irradiated to the cooking cavity or reflected on the side surface of the cooking cavity, is incident on the door assembly. Then, the microwave being incident on the door assembly does not leak to the external since the cooking cavity is completely and tightly covered with the door filter 200.

Also, the slot 225 includes the second slot 222 that is parallel to the length direction of the choke portion 220, and the first slot 221 that is vertical to the length direction of the choke portion 220. Thus, even though an angle of the microwave incident on the door assembly is changed, the optimum microwave-shielding frequency is not changed. Hereinafter, this structure will be described with reference to FIG. 10. For reference, FIG. 10 is a graph for illustrating microwave-shielding characteristics of the door filter.

Figure 10:
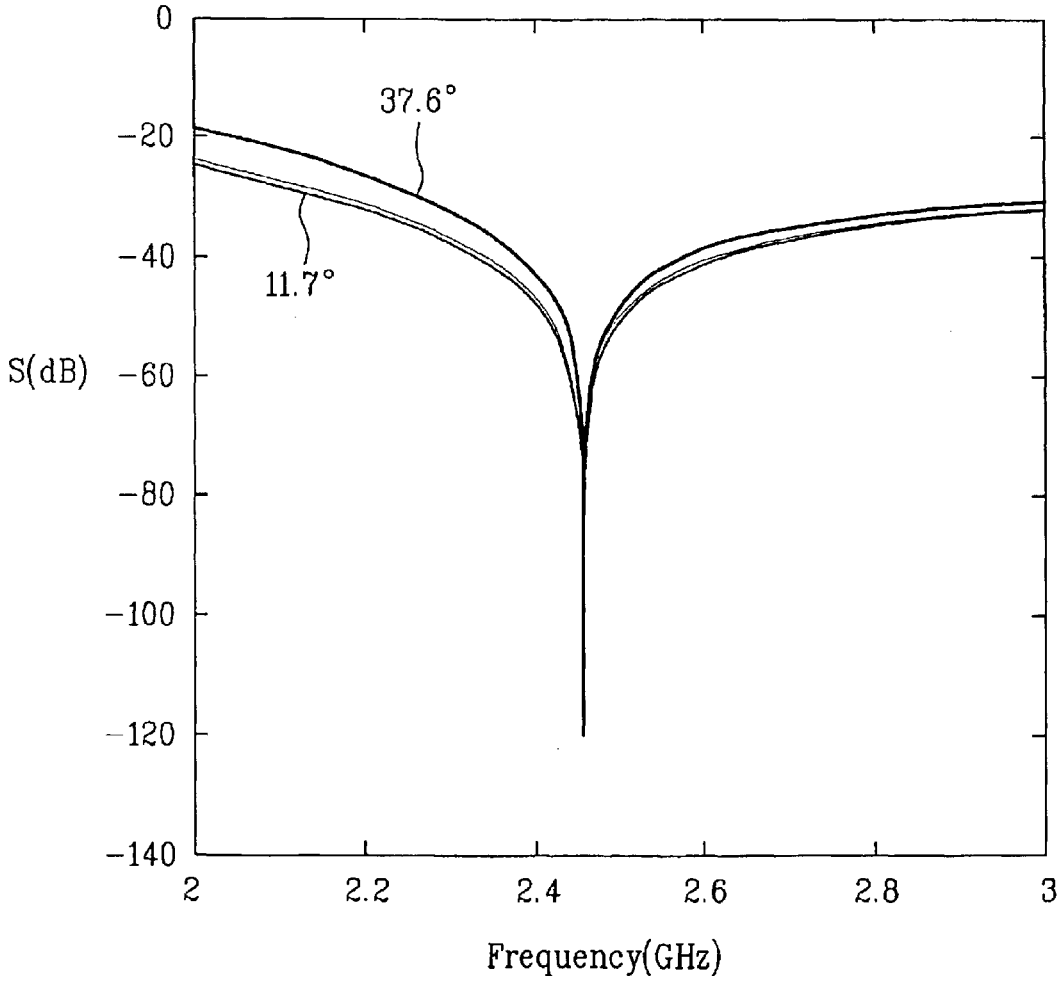
FIG. 10 is a graph illustrating microwave-shielding characteristics of a door assembly according to the present invention.

Referring to FIG. 10, in the door assembly including the choke portion 220 having the slot 225 according to the present invention, when the incident angle of the microwave is at 15.6°, 21.9°, and 35.6°, a corresponding frequency for forming a resonant point in each incident angle is about 2.45 GHz. That is, it means that the optimum microwave-shielding frequency is not changed according to the angle of the microwave incident on the door assembly. Accordingly, if the frequency of the microwave irradiated to the cooking cavity is about 2.45 GHz, it is possible to obtain the uniform microwave-shielding efficiency even though the incident angle of the microwave is changed.

As shown in FIG. 6 to FIG. 9, the slot 225 does not extend to the filter plate 210, so that the slot 225 is not exposed to the side of the cooking cavity when the door assembly is closed. Thus, moisture generated from food cooked in the cooking cavity does not soak through the slot 225, whereby it is possible to maintain the door assembly clean. Also, a user can easily clean the door assembly according to the present invention.

As mentioned above, the door assembly for the microwave or electric oven according to the present invention has the following advantages.

In the door assembly for the microwave or electric oven according to the present invention, it is possible to uniformly maintain the optimum microwave-shielding frequency without regard to the angle of the microwave incident on the door assembly, thereby improving the microwave-shielding efficiency of the door assembly.

Also, it is possible for the user to clean the door assembly easily and completely.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A The door assembly for a microwave oven comprising:

a door frame to open and close a cooking cavity; and a door filter including a filter plate adhered to one side of the door frame, a choke portion substantially perpendicular to the filter plate at an edge of the filter plate, a first slot formed in a width direction of the choke portion, and a second slot formed in a length direction of the choke portion, wherein the first and second slots are mutually perpendicular, wherein the first slot is provided along a direction being vertical to an end portion in the edge of the filter plate, and the second slot is provided along a direction being parallel to the end portion in the edge of the filter plate, and wherein one end of the second slot is connected with a central portion of the first slot.

2. The door assembly as claimed in claim 1, wherein the choke portion is provided at a predetermined interval from the door frame.

3. The door assembly as claimed in claim 1, wherein the plurality of first and second slots are provided at fixed intervals along the length direction of the choke portion.

4. The door assembly as claimed in claim 1, wherein the choke portion is bent in vertical to the filter plate.

5. The door assembly as claimed in claim 1, wherein the first slot is formed from a point provided at a predetermined interval from the edge of the filter plate to an end portion of the choke portion.

6. The door assembly as claimed in claim 1, wherein a length of the first slot is formed in a degree corresponding to ¼ of the wavelength (λ) of the microwave irradiated to the cooking cavity.

7. The door assembly as claimed in claim 1, wherein the second slot is provided between the first slot and the end portion in the edge of the filter plate.

8. The door assembly as claimed in claim 7, wherein one end of the first slot is connected with a central portion of the second slot.

9. The door assembly as claimed in claim 7, wherein one end of the first slot is connected with one end of the second slot.

10. A door assembly for a microwave oven comprising:

a door frame to open and close a cooking cavity; and a door filter including a filter plate adhered to one side of the door frame, a choke portion substantially perpendicular to the filter plate at an edge of the filter plate, a first slot formed in a width direction of the choke portion, and a second slot formed in a length direction of the choke portion, wherein the first and second slots are mutually perpendicular, wherein the first slot is provided along a direction being vertical to an end portion in the edge of the filter plate, and the second slot is provided along a direction being parallel to the end portion in the edge of the filter plate, and wherein the first and second slots cross each other.

11. A door assembly for a microwave oven comprising:

a door frame to a cooking cavity;

a door filter including a microwave filter plate on a side of the door frame, the microwave filter plate including a choke portion substantially perpendicular to the filter plate, at an edge of the microwave filter plate;

a first oblong slot within the choke portion, extending substantially perpendicularly to the filter plate from the edge of the microwave filter plate to an endpoint within the choke portion; and a second oblong slot within the choke portion, extending perpendicularly to the first oblong slot and intersecting with a central portion of the first oblong slot.

12. The door assembly as claimed in claim 11, wherein the choke portion is provided at a predetermined interval from the door frame.

13. The door assembly as claimed in claim 11, wherein the first and second oblong slots are provided at fixed intervals along a length direction of the choke portion.

14. The door assembly as claimed in claim 11, wherein the choke portion is bent vertically relative the microwave filter plate.

15. The door assembly as claimed in claim 11, wherein the first oblong slot is provided along a vertical direction relative to an end portion on the edge of the microwave filter plate, and the second oblong slot is provided along a parallel direction relative to the end portion on the edge of the microwave filter plate.

16. The door assembly as claimed in claim 15, wherein the first oblong slot extends from a point at a predetermined interval from the edge of the microwave filter plate to the endpoint within the choke portion.

17. The door assembly as claimed in claim 11 wherein a length of the first oblong slot corresponds to ¼ of a wavelength (λ) of microwave radiation irradiated to the cooking cavity.

18. The door assembly as claimed in claim 11, wherein the first and second oblong slots cross each other.

* * * * *